United States Patent [19]

Wayne

[11] 4,448,054

[45] May 15, 1984

[54] COIL WINDING APPARATUS

[75] Inventor: Albert Wayne, Muncie, Ind.

[73] Assignee: Westinghouse Electric Corp., Pittsburgh, Pa.

[21] Appl. No.: 496,873

[22] Filed: May 24, 1983

Related U.S. Application Data

[62] Division of Ser. No. 250,815, Apr. 3, 1981, abandoned.

[51] Int. Cl.[3] ..... B21C 47/00; B21F 3/08

[52] U.S. Cl. ..... 72/146; 29/605; 140/92.2

[58] Field of Search ..... 29/605; 72/146, 147, 72/148; 140/92.2

[56] References Cited

U.S. PATENT DOCUMENTS

| | | | |
|---|---|---|---|
| 1,813,994 | 7/1931 | George | 140/92.2 X |
| 2,140,137 | 12/1938 | Merkle | 140/92.2 |
| 3,368,174 | 2/1968 | Fischer | 336/60 |
| 3,750,719 | 8/1973 | Goldman et al. | 140/92.2 |

FOREIGN PATENT DOCUMENTS

| | | | |
|---|---|---|---|
| 696397 | 9/1940 | Fed. Rep. of Germany | 72/146 |

*Primary Examiner*—Carl E. Hall
*Attorney, Agent, or Firm*—L. P. Johns

[57] ABSTRACT

A coil winding procedure for winding pairs of coils, whereby a first coil is wound inwardly to the start and the second coil is wound from the start to the finish lead from the same continuous conductor strand, thereby eliminating the need for a start-start brazing operation.

5 Claims, 6 Drawing Figures

COIL WINDING APPARATUS

This application is a division of application Ser. No. 250,815, filed Apr. 3, 1981, now abandoned.

BACKGROUND OF THE INVENTION

1. Field of the Invention

This invention relates to windings for electrical inductive apparatus, such as transformers, and more particularly to a procedure for the elimination of a start-start brazing operation between adjacent pairs of coils.

2. Description of the Prior Art

A method frequently used to make windings for inductive apparatus is to form a flat disc or pancake type coil from a main conductor comprising a plurality of strands for conducting elements. When the current requirement for the apparatus is high, a sufficient number of thin pancake coils are connected in a parallel circuit relationship to provide the necessary quantity of conducting material. Or the number of strands per conductor has to be increased and the coils are connected in a series circuit relationship. In both cases a multiplicity of brazed joints are necessary to connect the individual coils. Various problems are incurred by brazed joints including the time consuming and costly procedure of making the joint. Another problem is the fact that eddy current losses are inherent in the brazed joints.

SUMMARY OF THE INVENTION

In accordance with this invention it has been found that connections between leads of adjacent coils may be eliminated by a method for making a plurality of adjacent electrical coils comprising the steps of providing a rotatable table for supporting coils during winding which table has restraining barrier means for defining the outer dimensions of a coil; dispensing a continuous strand of metal stock onto the table to form a spiral coil having an outer convolution, an inner convolution, an intermediate coil convolution with the outer convolution disposed against the barrier means; pressing the strand against the barrier means to form the outer convolution initially and progressively against the outer and intermediate convolutions to provide a first compact spiral coil; raising an inner convolution portion from the table and onto the next adjacent intermediate convolution as the table continues to rotate; and continuing to dispense the strand outwardly onto said intermediate convolutions to form a second coil having an outer convolution above the outer convolution of the first coil, whereby the inner convolutions of each coil are continuing integral portions of the strand.

Additional coils may be similarly wound by continuously winding successive pancake coils inwardly and outwardly with continuous connections between adjacent coils comprised of the same strand of conductor stock.

The advantage of the coil winding system of this invention is that start-start connections between adjacent coils, as well as the finish-finish connections, may be eliminated to reduce eddy currents which are otherwise inherent due to brazed joints at such connections. Moreover, coil assembly time is reduced due to the elimination of the brazing operations which are otherwise required. Also, losses are lowered due to decreased eddy current losses.

DESCRIPTION OF THE PREFERRED EMBODIMENTS

Figure 1:
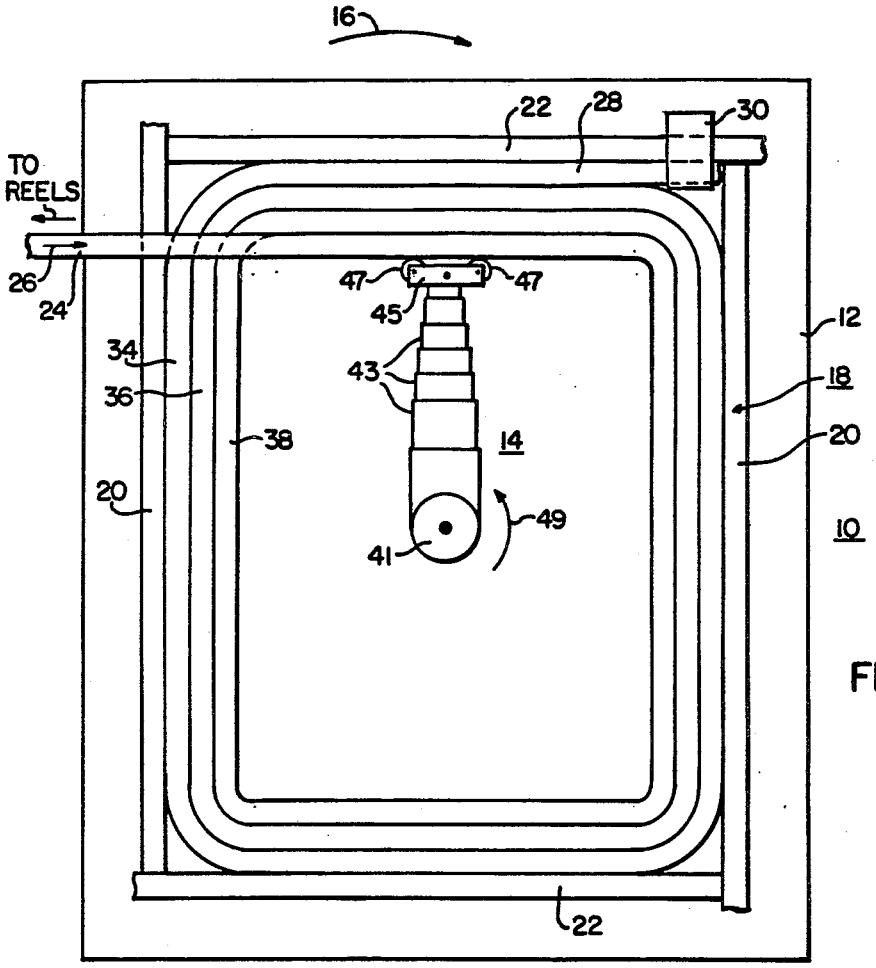
FIG. 1 is a plan view of a winding table showing a first coil in a partially wound stage.

Apparatus for winding coils is generally indicated at 10 in FIG. 1 and it comprises a winding table 12 and pressure means or jacking device 14. The winding table 12 is rotatable in the direction of the arrow 16 through 360°. Barrier means or a restraint 18 is disposed on the table surface for defining the coil length and width. The restraint 18 is a frame-like structure having similar opposite side members 20 as well as similar opposite end members 22. The members 20, 22 are preferably adjustably mounted in place for different sizes of coils.

A continuous strand 24 of electrically conductive materials, such as copper, is dispensed from suitable means, such as a reel (not shown), which is located adjacent to the table 12. The strand 24 moves in the direction of an arrow 26 and has a leading end 28 which is initially placed on the table adjacent one of the side members, such as side member 20, where it is preferably secured by a clamp 30. As the table is rotated in the direction of the arrow 16, the strand 24 falls into place against the several frame members 20, 22 for one complete revolution of the table 12. Thereafter, the strand 24 is disposed against the inner surface of each preceding turn, thereby forming a spiral coil 32 having a requisite number of turns or convolutions including an outer convolution 34, intermediate convolution 36, and an inner convolution 38. To simplify description only one intermediate convolution 36 is shown.

The pressure means or jacking device 14 is pivotally mounted on the table at 38 and comprises a hub 41 and a plurality of telescopic sleeves 43 as well as a wheel truck 45 having wheels 47 for engagement with the inner surface of the strand 24 as it placed on the table 12. The telescopic sleeves 43 support the wheel truck 45 in place. The jacking device 14 is retained in the extended position as shown by air pressure within the several sleeves and the length of the device is retractable in response to the addition of successive convolutions to the coil.

More particularly, as the table 12 is rotated the jacking device 14 engages the inner side of each turn or convolution 24 to press the outer surface of each turn against either the restraint 18 or the next adjacent convolution of the coil as it is seated in place. Although the device 14 preferably turns in the direction of the arrow 49, opposite to the direction of rotation of the table 12 as indicated by the arrow 16, the coil winding operation may also be performed where the device 14 remains stationary as the table turns.

Figure 6:
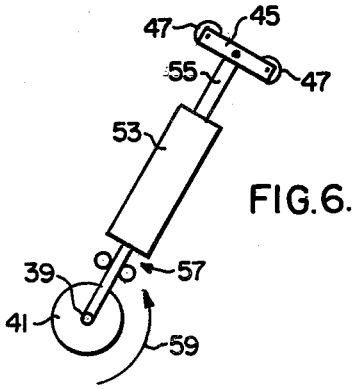
FIG. 6 is a fragmentary plan view of another embodiment of a jacking device.

Another embodiment of the device is shown in FIG. 6 in which similar numerals refer to similar parts. The device comprises a rod 51 which extends from the pivot 39 and supports a hydraulic cylinder 53. A piston rod 55 extends from the other end of the cylinder in which a piston is disposed for holding the rod in place. The wheel truck 45 is pivotally mounted at the outer end of the rod 55. Suitable means, such as a saddle 57, are provided for rotating the device in the direction of the arrow 59.

Accordingly, the winding table 12 performs the winding operation in conjunction with a jacking device 14 as the table rotates 360° around its center of rotation with the device rotating in a direction counter to the table of rotation, thereby forcing the winding turns against restraints which may be removably clamped on the surface of the winding table. The restraints define the coil length and width as well as the radii of the coil corners. The jacking device 14 transmits a jacking force to the winding turn, thereby rolling the strand against the restraints during the initial turn. Although the jacking device 14 is preferably operated by air pressure, other means such as a spring may be used to enable retraction of the device as succeeding convolutions or turns of the coil are applied. Clamps are used to hold the turn against the restraint until the next succeeding turn is forced against it by the jacking device. When the several convolutions 34, 36, 38 are applied, a first coil is completed.

Figure 2:
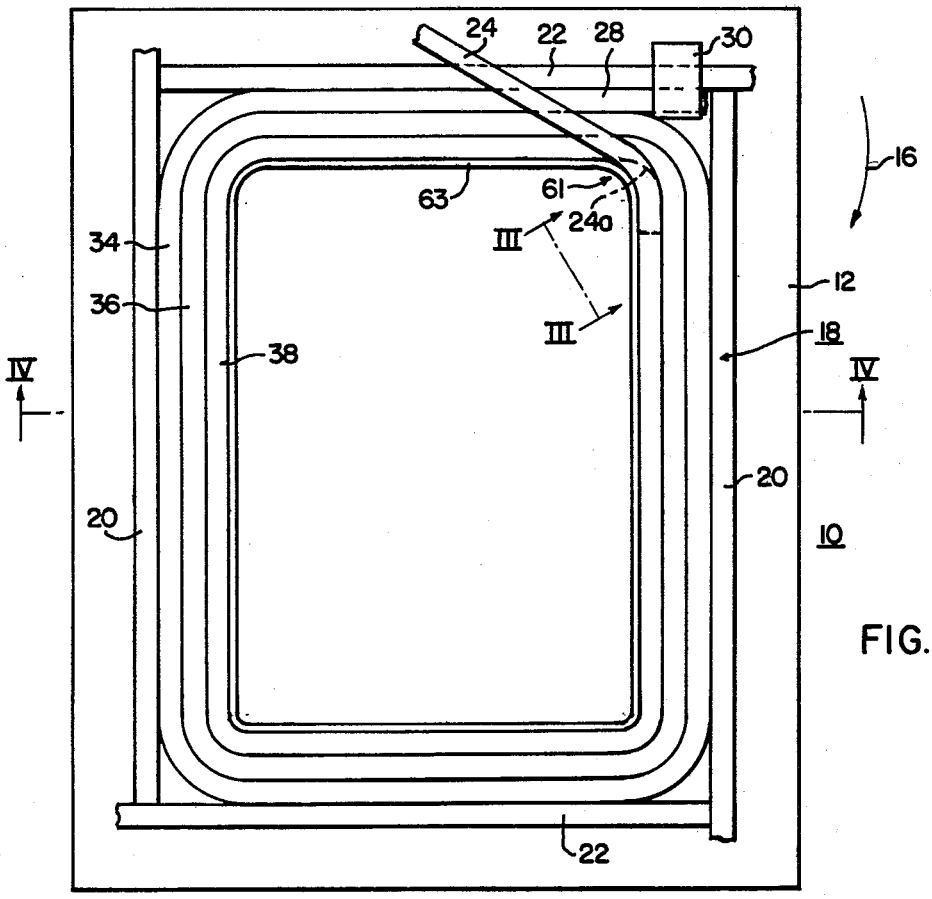
FIG. 2 is a plan view of a winding table at the commencement of the winding of a second coil.

In accordance with this invention a second coil is applied by transposing the strand 24 from the table top to a position above the inner convolution 38, such as at the location 61 (FIG. 2). The transposition involves raising or lifting the stand to form an inclined portion **24*a* (FIG. 3) from a surface of the table 12 to a position 24*b* above the inner convolution 38. For the purpose of providing the second coil above the first coil, the device 14 is removed and an inner mold or boot 63 is placed on the table and within the inner convolution 38 for guiding placement of the inner convolution of the second coil as it is placed upon the first coil. In addition, a thermal insulation spacer 65 (FIG. 3) is placed upon the first coil to cover all of the convolutions thereof during placement of the second coil convolutions. Accordingly, as the table 12 is rotated the second coil is formed by placement of the innermost convolution against the mold 63 and of subsequent convolutions spirally until the outer convolution for the second coil is disposed upon the outer convolution 34** of the first coil.

Figure 3:
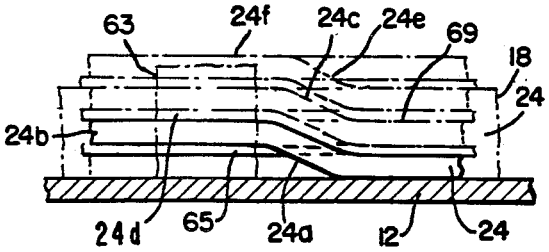
FIG. 3 is a sectional view, taken on the line III—III of FIG. 2, showing the manner in which two or more coils are transposed from lower to higher coil planes.
Figure 4:
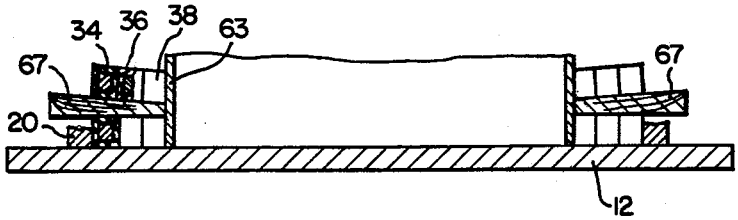
FIG. 4 is a fragmentary view showing the manner in which tapered ducts are disposed between coils as an alternative to non-tapered ducts.

Although flat spacers 65 are disclosed in FIG. 3, it is understood that tapered or wedged spacers 67 may be provided as shown in FIG. 4 for reasons known in the art.

Figure 5:
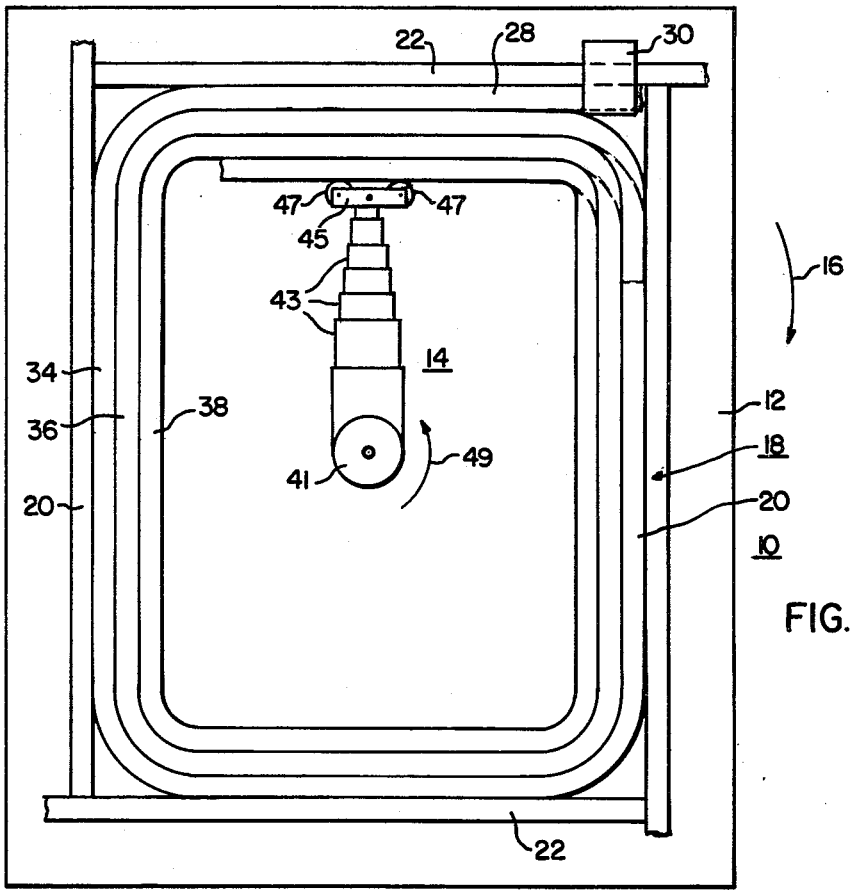
FIG. 5 is a plan view of the winding table after the last coil has been wound.

Ordinarily two coils are prepared as set forth above with a continuous connection therebetween (FIG. 3) as the strand 64 turns upward at 24*a* to commence the second coil at the inner convolution. It is pointed out, however, that more than two coils may be provided by continuing winding from the second coil to form a third coil. For that purpose (FIG. 5) as the outer convolution of the second coil reaches the location 69 a crossover is made whereby the strand 24 inclines upwardly at **24*c* (FIG. 3) and is continues at 24*d* as the outer convolution of the third coil in a manner similar to the first coil. An insulation spacer is disposed between the second and third coils. Inasmuch as the third coil is wound inwardly from the exterior, the jack device 15** is replaced and mounted on an extended drive shaft and spacer (not shown) for location at the level of the third coil to enable the jacking device to act upon the convolutions as they are set in place in a manner similar to that described for the first coil.

Thereafter a fourth coil may be added when the inner convolution of the third coil is completed. As shown more particularly in FIG. 3 as the strand 24 reaches the location above the inner convolution of the first coil (FIG. 3), a crossover is made whereby the strand is inclined upwardly at **24*e* where it becomes at 24*f*, the beginning of the inner convolution of the fourth coil as it is wrapped around the replaced mold 63** in a manner similar to the second coil as set forth above.

It is understood that all provisions or ties and all transpositions are made in the usual way such as shown in U.S. Pat. No. 3,368,174. When the first coil is completed the jacking device is removed from the table and the mold which is the same size as both coils plus the insulation spacer. The insulation spacers are comprised of material which substitutes for the ultimate insulation used, and remain between the coils during the winding process and during the passage of the coils through the oven. Thereafter the spacers are removed and replaced by the customary insulation of the same thickness.

In conclusion, the advantage of the apparatus and method of this disclosure is that by winding shell form transformer coils two at a time or more, the first coil from the finish lead inward to the start, then the second coil from the start to the finish lead is provided from the same continuous strand of insulated conductor, whereby the need for a start-start brazing operation is eliminated.

What is claimed is:

1. A coil winding apparatus for winding adjacent pancake type coils, said apparatus comprising:

(a) a winding table for supporting a coil during winding;

(b) restraining barrier means on the table surface for defining the outer dimensions of a coil;

(c) reel means adjacent to the table for storing and paying off a continuous strand of insulated metal onto the table and within the confines of the restraining barrier means;

(d) forming means for pressing the continuous strand against the restraining barrier means during placement of the outer coil turn and against each successive inner coil turn as the strand is placed spirally on the table;

(e) at least one of the forming means and the table being rotatable in such direction as to facilitate the placement of the strand in a spiral pattern, whereby a compact coil is formed;

(f) the forming means comprising a retractable member having leading surface means for forcing the strand radially outwardly; and (g) the retractable member being pivotally mounted on the table, and includes drive means for rotating the member in the direction of placement of the strand on the table.

2. The apparatus of claim 1 in which the retractable member is biased outwardly from a central location within the coil pattern.

3. The apparatus of claim 2 in which the winding table rotates.

4. The apparatus of claim 3 in which the retractable member is an elongated arm that is pivotally mounted on the table for rotation in a direction opposite that of the table, whereby the strand is formed into a compact coil.

5. The apparatus of claim 1 in which clamping means are provided for clamping the lead end portion of the strand in place on the table.

* * * * *